US010128036B2

(12) United States Patent
Dai et al.

(10) Patent No.: US 10,128,036 B2
(45) Date of Patent: Nov. 13, 2018

(54) AC PERMANENT MAGNET GAIN TRANSFORMER DEVICE AND ITS VOLTAGE REGULATION AND CONTROL METHOD

(71) Applicant: Shanshan Dai, Nanjing, Jiangsu (CN)

(72) Inventors: Shanshan Dai, Nanjing (CN); Shizhu Zhu, Nanjing (CN)

(73) Assignee: Shanshan DAI, Nanjing (CN)

( * ) Notice: Subject to any disclaimer, the term of this patent is extended or adjusted under 35 U.S.C. 154(b) by 0 days.

(21) Appl. No.: 15/941,185

(22) Filed: Mar. 30, 2018

(65) Prior Publication Data

US 2018/0226183 A1 Aug. 9, 2018

Related U.S. Application Data

(62) Division of application No. 15/038,268, filed as application No. PCT/CN2014/091694 on Nov. 19, 2014.

(30) Foreign Application Priority Data

Nov. 20, 2013 (CN) ..... 2013 1 0584381

(51) Int. Cl.
*H01F 21/00* (2006.01)
*H01F 17/06* (2006.01)
(Continued)

(52) U.S. Cl.
CPC ..... *H01F 27/245* (2013.01); *G05F 3/04* (2013.01); *H01F 27/25* (2013.01);
(Continued)

(58) Field of Classification Search
CPC ..... H01F 5/00; H01F 27/28; H01F 2038/127; H01F 41/0253; H01F 7/02; H01F 2003/103; H01F 7/122
(Continued)

(56) References Cited

U.S. PATENT DOCUMENTS 2,550,771 A 5/1951 Camp
2,680,820 A 6/1954 Duffing
(Continued)

FOREIGN PATENT DOCUMENTS

CN 102315006 A 1/2012
CN 202110932 U 1/2012
(Continued)

OTHER PUBLICATIONS

Feb. 17, 2015 Search Report issued in International Patent Application No. PCT/CN2014/091694.
(Continued)

*Primary Examiner* — Tsz Chan
(74) *Attorney, Agent, or Firm* — Oliff PLC

(57) ABSTRACT

An AC permanent magnet gain transformer device and its voltage regulation and control method. This device adds permanent magnet or permanent magnet assembly to the structure of traditional transformer, the magnetic pole surface of permanent magnet closely clings to laminated iron core, so that the intrinsic permanent magnetic potential of permanent magnet could be elicited under the excitation of the excitation current of primary winding, overlapped and compounded with excitation magnetic potential in the general magnetic loop of closed-loop laminated iron core, and so, it's able to induce the induction electromotive force formed after the superposition of excitation flux and permanent magnet flux at the output end of secondary winding. The method for voltage regulation and control of this invention is to: input a certain amplitude of pulse current to the primary winding in order to guarantee the generation of compound excitation effect, and change the pulse count of pulse current per unit time in order to change and adjust the input and output power of this AC permanent magnet gain transformer device. This AC permanent magnet gain trans-
(Continued)

former device and its voltage regulation and control method further enhance the power transfer efficiency of transformer device, thus make up the intrinsic spoilage of traditional winding coil and laminated iron core, and save energy.

5 Claims, 12 Drawing Sheets

(51) Int. Cl.

| | |
|---|---|
| ***H01F 27/24*** | (2006.01) |
| ***H01F 17/04*** | (2006.01) |
| ***H01F 7/06*** | (2006.01) |
| ***H01F 27/245*** | (2006.01) |
| ***G05F 3/04*** | (2006.01) |
| ***H01F 27/25*** | (2006.01) |
| ***H01F 27/28*** | (2006.01) |
| ***H01F 30/16*** | (2006.01) |
| *H01F 3/10* | (2006.01) |

(52) U.S. Cl.
CPC ..... *H01F 27/2823* (2013.01); *H01F 27/2895* (2013.01); *H01F 30/16* (2013.01); *H01F 2003/103* (2013.01)

(58) Field of Classification Search
USPC ..... 336/200, 232; 29/602.1
See application file for complete search history.

(56) References Cited

U.S. PATENT DOCUMENTS

| | | | |
|---|---|---|---|
| 3,460,079 | A | 8/1969 | Di Marco |
| 2012/0161917 | A1 | 6/2012 | Henning, III et al. |
| 2012/0235636 | A1 | 9/2012 | Partovi |

FOREIGN PATENT DOCUMENTS

| | | | |
|---|---|---|---|
| CN | 102385979 | A | 3/2012 |
| CN | 102760873 | A | 10/2012 |
| CN | 103559981 | A | 2/2014 |
| DE | 3821284 | A1 | 12/1989 |
| JP | 2012207984 | A | 10/2012 |

OTHER PUBLICATIONS

Feb. 17, 2015 Written Opinion issued in International Patent Application No. PCT/CN2014/091694.
Nov. 30, 2017 Office Action issued in U.S. Appl. No. 15/038,268.

B-B

C-C

AC PERMANENT MAGNET GAIN TRANSFORMER DEVICE AND ITS VOLTAGE REGULATION AND CONTROL METHOD

This application is a divisional application of U.S. patent application Ser. No. 15/038,268 filed Oct. 14, 2016, which is in turn a U.S. National Stage of International Application No. PCT/CN2014/091694, filed Nov. 19, 2014, which claims the benefit of Chinese Patent Application No. 201310584381.8 filed Nov. 20, 2013. The disclosure of the prior applications is hereby incorporated by reference herein in their entirety.

TECHNICAL FIELD

This invention involves an electronic transformer device, especially an energy-saving transformer device with permanent magnet synergistic effect, and its voltage regulation and control method.

BACKGROUND TECHNOLOGY

Electronic transformer is a regular electronic device with a very broad scope of application, and it generally plays the role of voltage transformation, circuit isolation and protection, and impedance matching. The coil and soft magnet of traditional electronic transformers inevitably have spoilage, so that the power transfer efficiency is lowered.

INVENTION CONTENT

The objective of this invention is to add permanent magnet to the structure of the traditional transformer consisting of laminated iron core and winding coil, so as to make the intrinsic permanent-magnet magnetic potential of the permanent magnet superimposed and compounded with the excitation magnetic potential formed by the excitation current of primary winding in the general magnetic loop of laminated iron core, thus to produce the induction electromotive force of compound excitation at the output end of secondary winding, and guarantee the permanent-magnet synergistic effect through certain voltage regulating and control method, so as to lower the intrinsic spoilage of the transformer, raise the power transfer efficiency of this transformer, and save energy.

In order to realize the abovementioned objective, the first embodiment of this invention is, an AC permanent magnet gain transformer device consists of rectangular closed-loop laminated iron core, primary winding and secondary winding, and wherein, its structure further includes permanent magnet assembly, the said primary windings are respectively divided into L1 and L2 groups, and L1 and L2 are respectively wounded around the periphery of two vertical frameworks of the rectangular closed-loop laminated iron core; the said secondary winding is L, and L is wounded around the periphery of the horizontal framework of the rectangular closed-loop laminated iron core; the number of the said permanent magnet assembly, the magnetic pole S and magnetic pole N of one first permanent magnet assembly cross over primary winding L1, and Wherein the magnetic pole S is connected with the vertical framework of the rectangular closed-loop laminated iron core above primary winding L1, and the magnetic pole N is connected with the vertical framework of the rectangular closed-loop laminated iron core below primary winding L1; similarly, the magnetic pole S and magnetic pole N of second permanent magnet assembly cross over primary winding L2, and wherein the magnetic pole S is connected with the vertical framework of the rectangular closed-loop laminated iron core above primary winding L2, and the magnetic pole N is connected with the vertical framework of the rectangular closed-loop laminated iron core below primary winding L2. That's to say, the magnetic field direction of the two permanent magnet assemblies is the same as that of the windings set up in parallel with the two assemblies under electric excitation, while the direction of superimposed magnetic field generated under electric excitation by the two permanent magnet assemblies and the windings set up in parallel with the two assemblies respectively is opposite in a same closed-loop magnetic loop.

In the abovementioned first embodiment, the said permanent magnet assembly consists of two permanent magnets and one magnetizer. The upper end of this magnetizer is connected with the magnetic pole N of one permanent magnet, and the lower end of this magnetizer is connected with the magnetic pole S of another permanent magnet. One first permanent magnet assembly crosses over primary winding L1. The upper-end magnetic pole S of this permanent magnet assembly is connected with the vertical framework of the rectangular closed-loop laminated iron core above the primary winding L1, and the lower-end magnetic pole N of this permanent magnet assembly is connected with the vertical framework of the rectangular closed-loop laminated iron core below the primary winding L1. Second permanent magnet assembly crosses over primary winding L2. The upper-end magnetic pole S of this permanent magnet assembly is connected with the vertical framework of the rectangular closed-loop laminated iron core above the primary winding L2, and the lower-end magnetic pole N of this permanent magnet assembly is connected with the vertical framework of the rectangular closed-loop laminated iron core below the primary winding L2.

In the abovementioned first embodiment, the said primary windings L1 and L2 are connected in series, and the primary windings L1 and L2 such that, in a same closed magnetic loop, when positive pulse current is input into primary windings L1 and L2, the direction of electric excitation magnetic field generated by primary windings L1 and L2 is same as, and when reverse pulse current is input into the primary windings L1 and L2, the direction of the electric excitation magnetic field generated by primary windings L1 and L2 is same as, but in a closed magnetic loop, the direction of the magnetic field generated by the two reverse pulse currents is opposite.

In the abovementioned first embodiment, the laminated surface of the said rectangular closed-loop laminated iron core is parallel to paper surface, and the magnetic pole S and magnetic pole N of permanent magnet assembly closely cling to the laminated section of the rectangular closed-loop laminated iron core; Or, the laminated surface of the said rectangular closed-loop laminated iron core is vertical to paper surface, and the magnetic pole S and magnetic pole N of permanent magnet assembly closely cling to the laminated section of the rectangular closed-loop laminated iron core;

In the abovementioned first embodiment, the said rectangular closed-loop laminated iron core is made of sheet-shaped iron-based nano alloy soft-magnet material by means of lamination.

In order to realize the abovementioned objective, the second embodiment of this invention is another AC permanent magnet gain transformer device, its structure includes round closed-loop laminated iron core, primary winding and secondary winding, wherein, its structure further includes the permanent magnet, there is a gap at the opposite angle positions of the diameter line of the round closed-loop laminated iron core respectively, the two permanent magnets are embedded into the two gaps, the magnetic pole N of one permanent magnet closely clings to the laminated iron core in clockwise direction, and its magnetic pole S closely clings to the laminated iron core in counter-clockwise direction; the magnetic pole N of another permanent magnetic closely clings to the laminated core in counter-clockwise direction, and its magnetic pole S closely clings to the laminated iron core in clockwise direction. Air gap between the lateral sides of two permanent magnets and the laminated iron core The said primary windings are divided into L1 and L2 groups. L1 and L2 are wounded at the diagonal positions of the framework of the round closed-loop laminated iron core. The said secondary winding L is divided into two windings La and Lb, which are wounded at the diagonal positions of the framework of the round closed-loop laminated iron core, located between primary windings L1 and L2, and connected in series or parallel before being output.

In the abovementioned second embodiment, the said primary windings L1 and L2 are mutually independent, and unidirectional pulse current is alternatively input into the primary windings L1 and L2. The primary winding L1 such that the direction of electric excitation magnetic field generated when current is input into L1 be the same as the direction of the magnetic field of the one permanent magnet closest to L1, namely in the round closed-loop magnetic loop, the electric excitation magnetic field of L1 and L2 is the opposite, and the direction of magnetic field in ring-shaped magnetic path of two permanent magnet assemblies is also opposite; Or, the said primary windings L1 and L2 are connected in series. The primary windings L1 and L2 such that, when positive pulse current is input into primary windings L1 and L2, the superposition of electric excitation flux of L1 and L2 will be formed inside the round closed-loop laminated iron core, and the direction of excitation flux is positive; when reverse pulse current is input into primary windings L1 and L2, the superposition of electric excitation flux of L1 and L2 will be formed inside the round closed-loop laminated iron core, and the direction of excitation flux is reverse.

In the abovementioned second embodiment, the laminated surface of the said round closed-loop laminated iron core is vertical to paper surface, magnetic pole N and magnetic pole S of permanent magnet closely cling to the laminated section of the round closed-loop laminated iron core; Or, the laminated surface of the said round closed-loop laminated iron core is vertical to paper surface, magnetic pole N and magnetic pole S of permanent magnet closely cling to the laminated section of the round closed-loop laminated iron core.

In the abovementioned second embodiment, the said round closed-loop laminated iron core is made of sheet-shaped iron-based nano alloy soft-magnet material by means of lamination and winding.

The common technical characteristic of the abovementioned first and second embodiments of this invention is that, permanent magnet or permanent magnet assembly is added to the structure of the traditional transformer consisting of laminated iron core and winding coil, so that the permanent-magnet magnetic potential of the permanent magnet could be elicited under the excitation of the excitation current of primary winding, superimposed and compounded with excitation magnetic potential in the general magnetic loop of closed-loop laminated iron core, and thus to produce the permanent magnet synergistic effect at the output end of the secondary winding. The mechanism and process of the compounding and superposition of permanent magnet flux and excitation flux are that: If no current is input into the primary winding, permanent magnet assembly or permanent magnet and closed-loop laminated iron core will locally form closed permanent magnet flux. If current is input into the primary winding, this winding will not only form loop-shaped excitation flux inside the loop-shaped laminated iron core, but also act on the closed permanent magnet flux, make partial permanent magnet flux imported into the loop-shaped general magnetic loop of the closed-loop laminated iron core, thus realize the superposition of excitation flux and permanent magnet flux. At this moment, at the output end of the secondary winding, it is able to induce the induction electromotive force formed from the superposition of excitation flux and permanent magnet flux.

In order to guarantee that every pulse current input into the primary winding could obtain the compound and superposed effect of permanent magnet flux and excitation flux, this invention provides a voltage regulating and control method. Change the pulse count in an unit time of the pulse current input into primary windings in the precondition that the amplitude of every pulse current input into the primary windings could obtain the compounded and superimposed effect of permanent magnet flux and excitation flux, so as to change and adjust the input and output power of this AC permanent magnet gain transformer device. The concrete control mechanism of this voltage regulation and control method is as shown below: In a synergistic closed magnetic loop with matching parameters and jointly consisting of permanent magnet, laminated iron core, primary winding and secondary winding, positive and negative alternating pulse current of square wave or approximate square wave is used to excite primary winding, in order to ensure that the amplitude of every pulse current of square wave or approximate square wave is higher than a threshold, namely make the density of excitation flux which could be generated by the amplitude of every pulse current in the closed synergistic closed magnetic loop be higher than a threshold, or make the density of excitation flux generated be equal to or higher than the density of the static permanent magnet flux formed by the permanent magnet assembly set up in parallel with this primary winding, so as to, in the synergistic closed magnetic loop and under the electric excitation flux of primary winding, make the original permanent magnet flux change its direction, turn into dynamic flux, and superposed and compounded with electric excitation flux. In synergistic magnetic loop, new closed magnetic loop is formed. This superposed and compound magnetic flux cuts the secondary winding wound on the magnetic loop of laminated iron core, and produces induction electromotive force of compound excitation. This induction electromotive force of compound excitation is obviously higher than the induction electromotive force of simple electric excitation. If the value of the input excitation pulse current is maintained unchanged, and the frequency of positive and negative alternating current pulse is changed, it will be able to obtain the secondary winding induction electromotive force of compound excitation at different frequencies.

The advantages of this invention are as shown below:

1. This invention skillfully combines the permanent magnet assembly or permanent magnet with traditional transformer device in structural design, so that the intrinsic magnetic energy potential with unchanged magnetic pole direction of the permanent magnet assembly or permanent magnet could be elicited and used. This further enhances the power transfer efficiency of transformer device, compensates the intrinsic spoilage/loss of traditional winding coil and laminated iron core, and saves energy.

2. The two magnetic poles of the permanent magnet assembly or permanent magnet of this invention closely cling to the laminated section of the laminated iron core. This lowers the spoilage/loss of the intrinsic permanent magnetic energy potential of the permanent magnet assembly or permanent magnet in the laminated iron core, and simplifies the structure.

3. This invention adopts high-performance sheet-shaped iron-based nano alloy soft-magnet material to produce laminated iron core. The thickness of every piece of iron-based nano non-crystal material is equal to or smaller than 0.003 mm, so that the magnetic substance spoilage/loss aroused by magnetic vortex inside the laminated iron core is further lowered,

DESCRIPTION OF ATTACHED FIGURES

In the above attached Figures,

10 indicates rectangular closed-loop laminated iron core,
11 indicates magnetizer,
12 indicates permanent magnet,
13 indicates primary winding L1,
14 indicates primary winding L2,
15 indicates secondary winding,
20 indicates upper permanent magnet,
21 indicates round closed-loop laminated iron core,
22 indicates secondary winding La,
23 indicates primary winding L1,
24 indicates primary winding L2,
25 indicates secondary winding Lb,
26 indicates lower permanent magnet,
27 indicates the air gap between upper permanent magnet and laminated iron core,
28 indicates the air gap between lower permanent magnet and laminated iron core,
29 indicates the upper section of round closed-loop laminated iron core,
30 indicates the lower section of round closed-loop laminated iron core,
31 indicates the schematic direction (out of paper surface) of magnetic line formed by the upper permanent magnet,
32 indicates the schematic direction (into paper surface) of magnetic line formed by the upper permanent magnet,
33 indicates the schematic direction (out of paper surface) of magnetic line formed by the lower permanent magnet,
34 indicates the schematic direction (into paper surface) of magnetic line formed by the lower permanent magnet,
35 indicates the schematic direction (out of paper surface) of magnetic line formed by the primary winding L1 excitation flux,
36 indicates the schematic direction (into paper surface) of magnetic line formed by the primary winding L1 excitation flux,
37 indicates the schematic direction (out of paper surface) of magnetic line formed by the primary winding L2 excitation flux, and
38 indicates the schematic direction (into paper surface) of magnetic line formed by the primary winding L2 excitation flux.

CONCRETE IMPLEMENTATION METHODS

Embodiment 1

Figure 1:
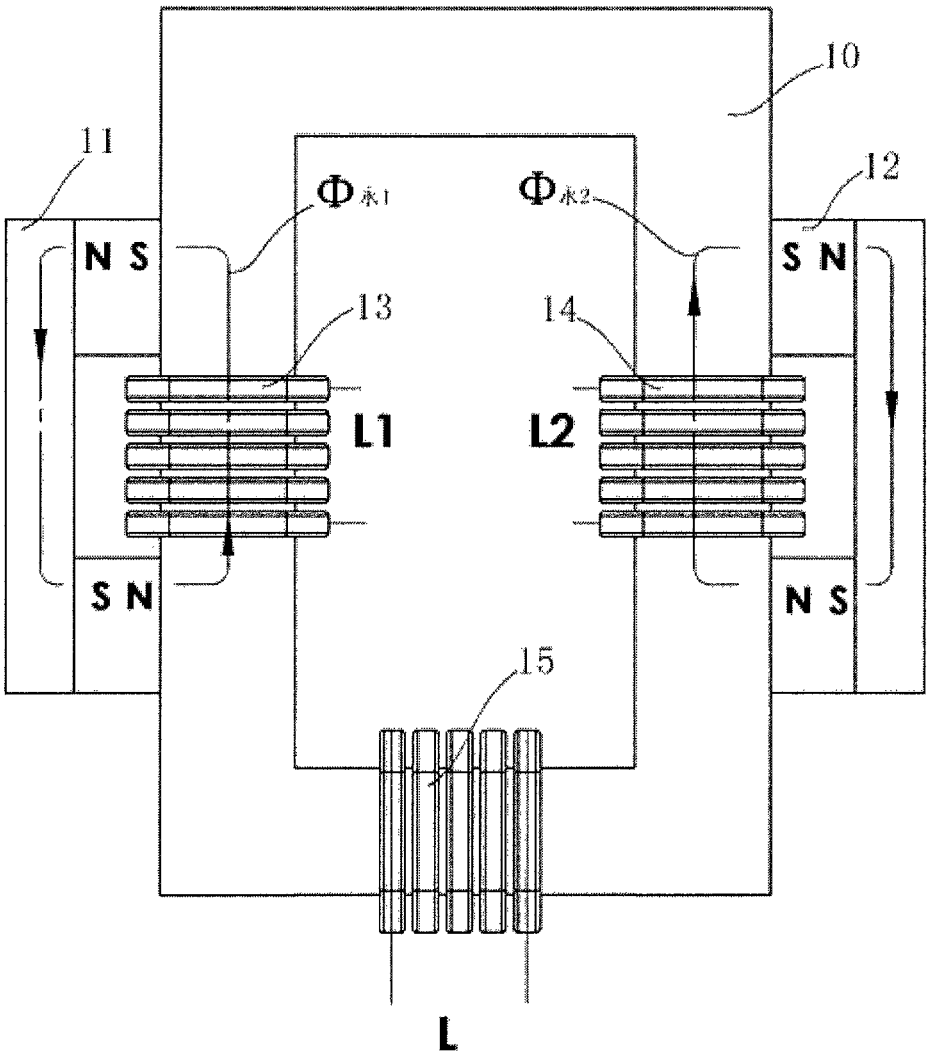
FIG. 1 is the schematic diagram of the permanent magnet flux in the laminated iron core of transformer device under condition that primary windings L1 and L2 are mutually independent and not powered on, as shown in the first embodiment of this invention.
Figure 2:
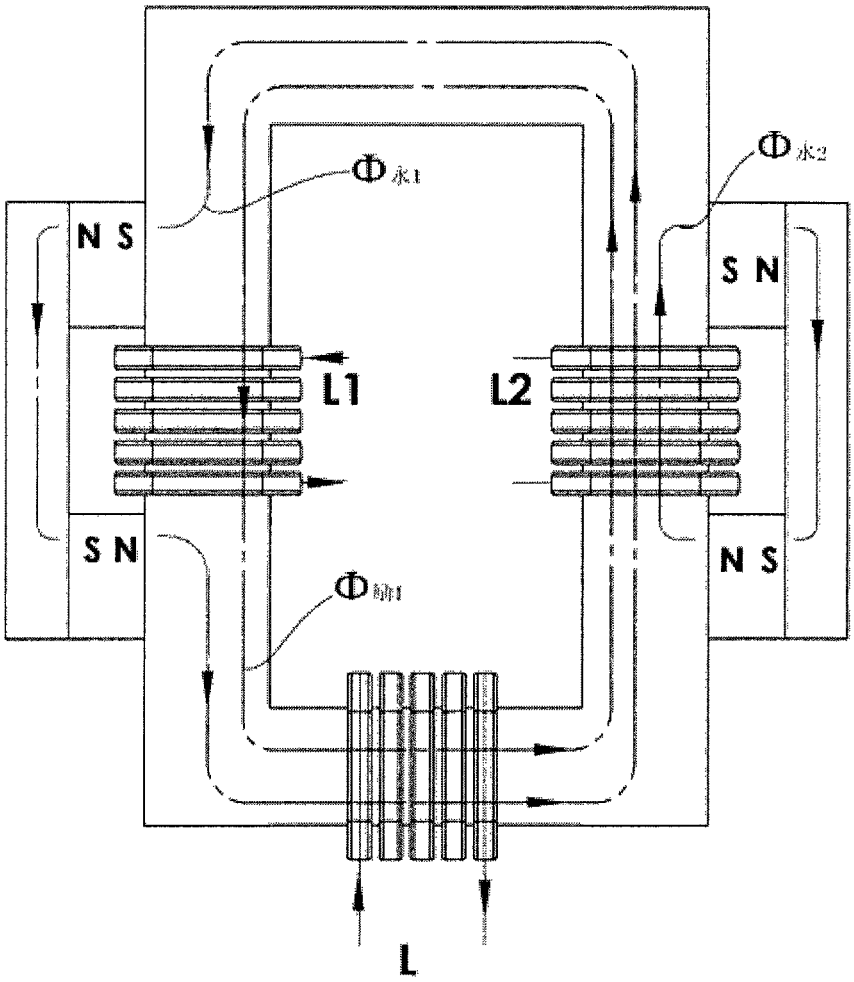
FIG. 2 is the schematic diagram of the superposed compounding of the excitation flux and permanent magnet flux in the laminated iron core of transformer device under condition that primary windings L1 and L2 are mutually independent, primary winding L1 is powered on, and primary winding L2 is not powered on, as shown in the first embodiment of this invention.
Figure 3:
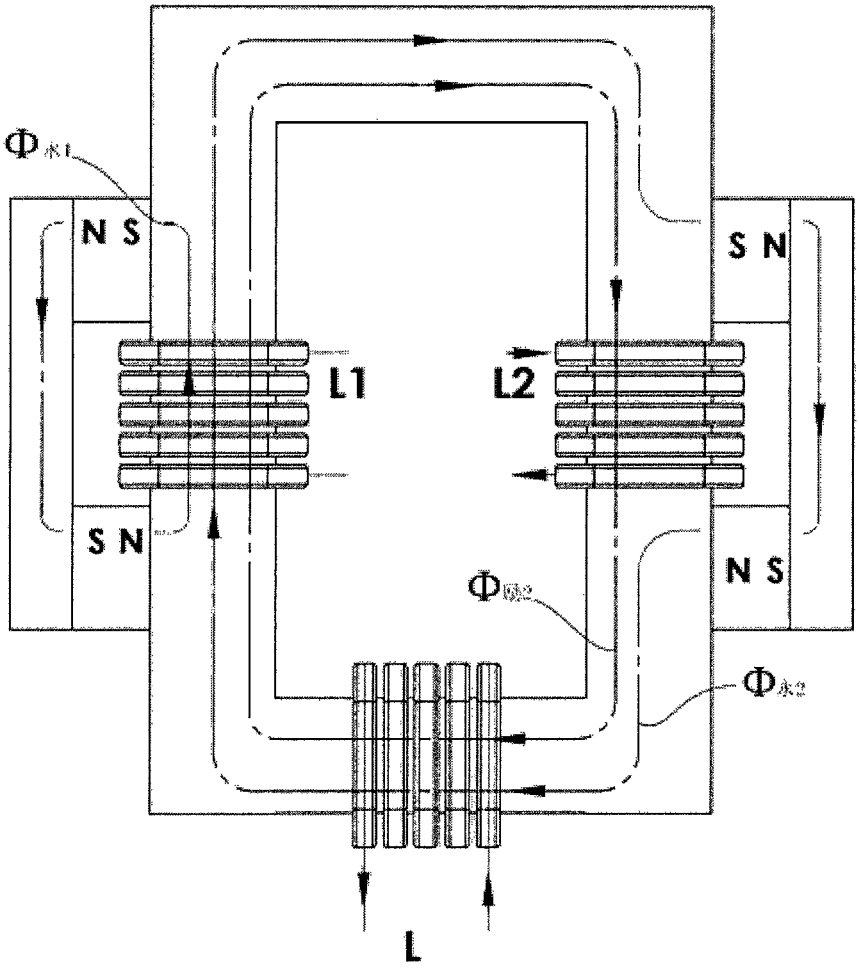
FIG. 3 is the schematic diagram of the excitation magnetic energy and permanent magnet flux in the laminated iron core of transformer device under condition that primary windings L1 and L2 are mutually independent, primary winding L1 is not powered on and primary winding L2 is powered on, as shown in the first embodiment of this invention.

This embodiment illustrates a transformer with rectangular closed-loop laminated iron core, and its structure is shown in the FIGS. 1, 2 and 3.

In this embodiment, the laminated iron core 10 is a rectangular closed-loop; the primary windings are divided into L1 and L2 groups and are mutually independent. L1 group is wound around the vertical framework at the left side of the rectangular closed loop, and the winding method of primary winding L1 will make the direction of electric excitation magnetic field generated by L1 input with a unidirectional pulse current to be the same as the direction of the magnetic field generated by the permanent magnet assembly crossing the primary winding L1. Namely, when a current is input into L1, the laminated iron core above the winding L1 will present the magnetic polarity S, and the laminated iron core below the winding L1 will present the magnetic polarity N. L2 group is wound around the vertical framework at the right side of the rectangular closed loop, and the winding method of primary winding L2 will make the direction of electric excitation magnetic field generated by L2 input with a unidirectional pulse current to be the same as the direction of the magnetic field generated by the permanent magnet assembly crossing the primary winding L2. Namely, when a current is input into L2, the laminated iron core above the winding L2 will present the magnetic polarity S, and the laminated iron core below the winding L2 will present the magnetic polarity N. The secondary winding L is wound around the horizontal framework below the rectangular closed loop.

In this embodiment, the permanent magnet assembly consists of two permanent magnets 12 and one magnetizer 11. The upper end of this magnetizer is connected with the magnetic pole N of one permanent magnet, and the lower end of this magnetizer is connected with the magnetic pole S of another permanent magnet. The magnetic pole S and magnetic pole N of the left-sided permanent magnet assembly are respectively cross over the primary winding L1, and its magnetic pole S is connected with the left-sided vertical framework of the laminated iron core above the primary winding L1, and its magnetic pole N is connected with the left-sided vertical framework of the laminated iron core below the primary winding L1. The magnetic pole S and magnetic pole N of the right-sided permanent magnet assembly are respectively cross over the primary winding L2, and its magnetic pole S is connected with the right-sided vertical framework of the laminated iron core above the primary winding L2, and its magnetic pole N is connected with the right-sided vertical framework of the laminated iron core below the primary winding L2.

In this embodiment, the laminated surface of the rectangular closed-loop laminated iron core is parallel to the paper surface. The laminated iron core is made of many layers of 0.003 mm thick iron-based nano alloy soft-magnetic material by means of lamination, and the magnetic pole S and magnetic pole N of the permanent magnet assembly closely cling to the laminated section of the laminated iron core.

If no current is input into L1 and L2, as shown in FIG. 1, no magnetic flux will be formed in the whole loop of the rectangular closed-loop laminated iron core. Only between the two magnetic poles of the left-sided permanent magnet assembly, the permanent magnet flux $\Phi_{permanent\ 1}$ will be formed in the partial section of the vertical framework at the left side of the rectangular closed loop of the laminated iron core. Similarly, between the two magnetic poles of the right-sided permanent magnet assembly, the permanent magnet flux $\Phi_{permanent\ 2}$ will be formed in the partial section of the vertical framework at the right side of the rectangular closed loop of the laminated iron core. At this moment, the permanent magnet fluxes $\Phi_{permanent\ 1}$ and $\Phi_{permanent\ 2}$ do not make contributions to the total magnetic flux of the rectangular closed loop, the total magnetic flux $\Phi_{total}$ of the rectangular closed loop is 0 (zero), so that no induction electromotive force is output from both ends of the secondary winding L.

If a unidirectional pulse current is input into L1 and not input into L2, as shown in FIG. 2, the excitation flux $\Phi_{excitation\ 1}$ will be formed in the integrated magnetic circuit of the rectangular closed-loop laminated iron core, and meanwhile, the magnetic flux $\Phi_{permanent\ 1}$ of the left-sided permanent magnet assembly will be imported into the integrated magnetic circuit of the rectangular closed-loop laminated iron core. At this moment, the total magnetic flux in the integrated magnetic circuit of the laminated iron core will be $\Phi_{total}=\Phi_{excitation\ 1}+\Phi_{permanent\ 1}$, so that the corresponding positive electromotive force will be induced from both ends of the secondary winding L. During this period, the permanent magnet flux $\Phi_{permanent\ 2}$ of the right-sided permanent magnet assembly still exists.

If a unidirectional pulse current is input into L2 but not input into L1, as shown in FIG. 3, the excitation flux $\Phi_{excitation\ 2}$ will be formed in the integrated magnetic circuit of the rectangular closed-loop laminated iron core, and meanwhile, the magnetic flux $\Phi_{permanent\ 2}$ of the right-sided permanent magnet assembly will be imported into the integrated magnetic circuit of the rectangular closed-loop laminated iron core. At this moment, the total magnetic flux of the integrated magnetic circuit of the laminated iron core will be $\Phi_{total}=\Phi_{excitation\ 2}+\Phi_{permanent\ 2}$, so that the corresponding reverse electromotive force will be induced at both ends of the secondary winding L. During this period, the permanent magnet flux $\Phi_{permanent\ 1}$ of the left-sided permanent magnet assembly still exists.

If a unidirectional pulse current is alternatively input into the primary windings L1 and L2, then the positive and reverse electromotive force will be induced at both ends of the secondary winding L. Both ends of the secondary winding L may also be connected to the input end of the bridge-type rectifier and filter circuit, and DC current will be output from the output end of the bridge-type rectifier and filter circuit.

In this embodiment, in order to ensure that every pulse current input into primary windings L1 and L2 could obtain the compounding and superposition effects of permanent magnet flux and. excitation flux, the square wave pulse current alternatively input into L1 and L2 shall reach the determined amplitude, and the amplitude of every square wave pulse current shall be ensured to be higher than a threshold. Namely, the density of excitation flux which could be generated by every pulse current in the closed synergistic closed magnetic loop shall be higher than a threshold, or the density of excitation flux generated shall be equal to or higher than the density of the static permanent magnet flux formed by the permanent magnet assembly set up in parallel with this primary winding, namely meeting the condition of that $\Phi_{excitation\ 1}\geq\Phi_{permanent\ 1}$ or $\Phi_{excitation\ 2}\geq\Phi_{permanent\ 2}$. Hence, in the synergistic closed magnetic loop and under the electric excitation flux of the primary winding, the original permanent magnet flux changes its direction, and turns into dynamic flux. The dynamic flux is superposed and compounded with the electric excitation flux. In synergistic magnetic loop, new closed magnetic loop is formed. This superposed and compound magnetic flux $\Phi_{total}$ cuts the secondary winding wound on the magnetic loop of laminated iron core, and produces an induction electromotive force of compound excitation. This induction electromotive force of compound excitation is obviously higher than the induction electromotive force of simple electric excitation. If the value of the input excitation pulse current is maintained unchanged, and the frequency of the pulse current input into the primary windings L1 and L2 is changed, it will be able to obtain the secondary winding induction electromotive force of compound excitation at different frequencies. This voltage regulating and control method is to change and adjust the input and output power of this AC permanent-magnet synergistic transformer device by changing the pulse count per unit time of pulse current input for the primary winding.

Embodiment 2

Figure 4:
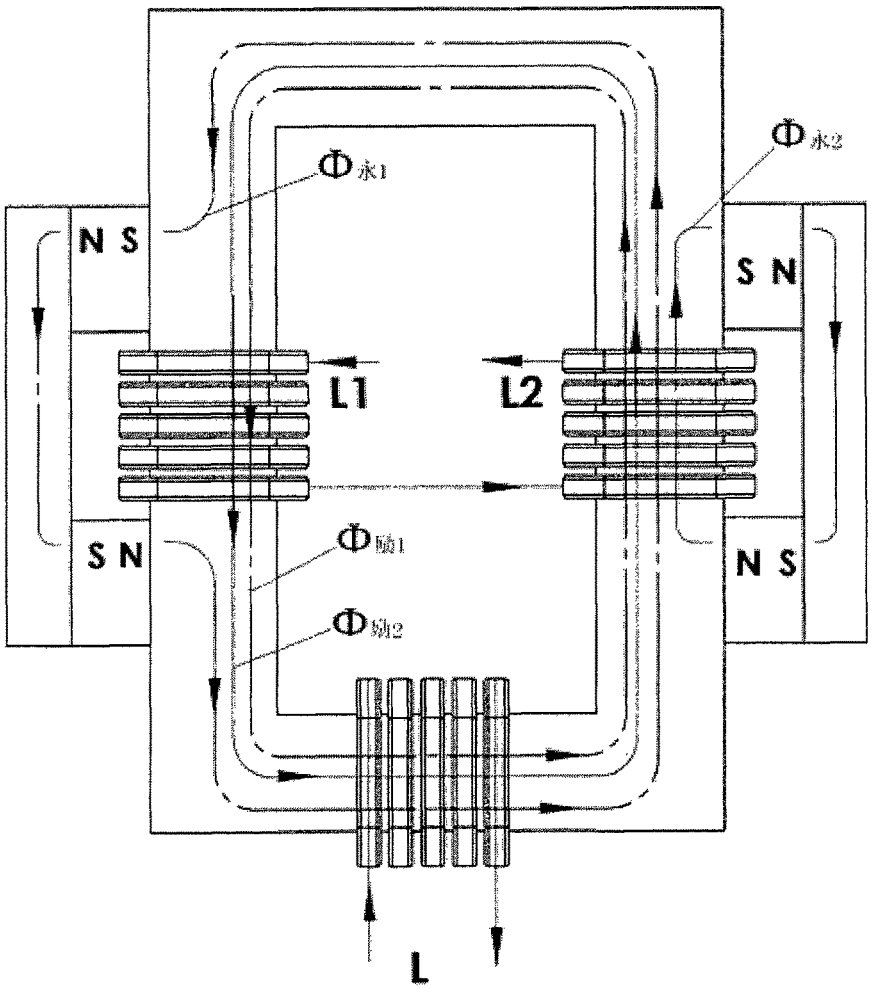
FIG. 4 is the schematic diagram of the excitation magnetic energy and permanent magnet flux in the laminated iron core of transformer device under condition that primary windings L1 and L2 are mutually connected in series and input positive pulse current, as shown in the first embodiment of this invention.
Figure 5:
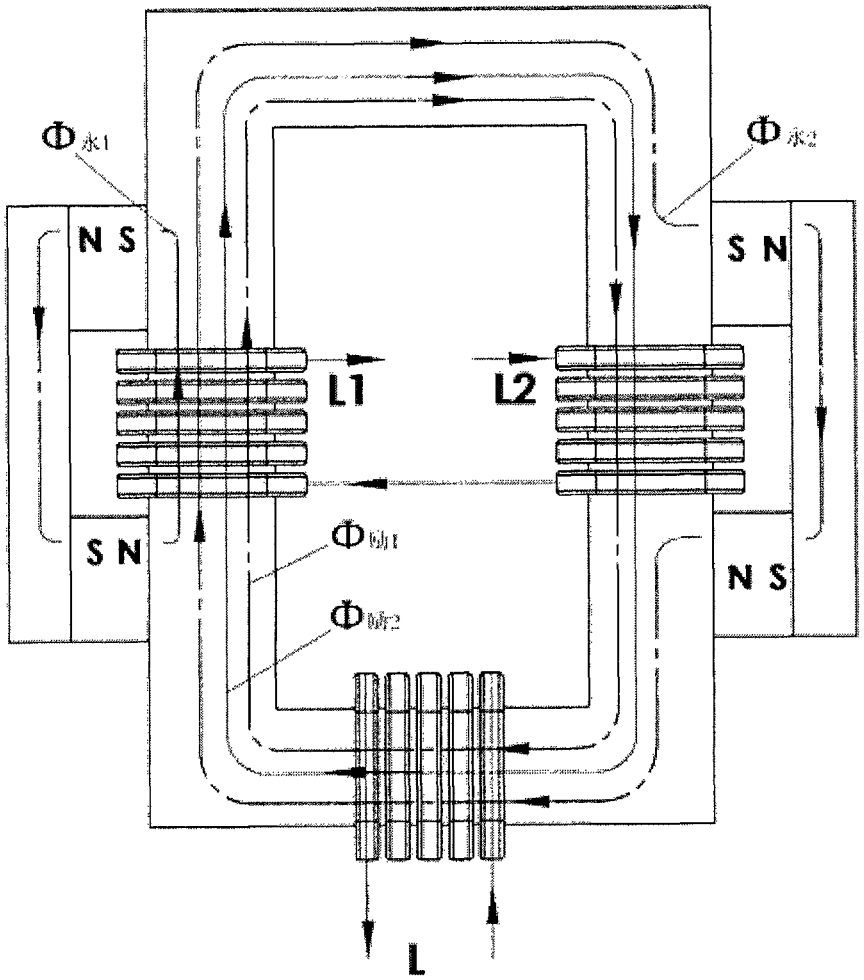
FIG. 5 is the schematic diagram of the excitation magnetic energy and permanent magnet flux in the laminated iron core of transformer device under condition that primary windings L1 and L2 are mutually connected in series and input reserve impulse current, as shown in the first embodiment of this invention.

This embodiment illustrates another transformer with a rectangular closed-loop laminated iron core, and its structure is shown in the FIGS. 4 and 5.

In this embodiment, the structural form of the rectangular closed-loop laminated iron core, the primary winding, the secondary winding and the permanent magnet assembly is similar to that of the embodiment 1. The difference only rests with that, the primary windings L1 and L2 are connected in series, and the winding method of the primary windings L1 and L2 shall meet the following conditions: when a positive pulse current is input into the primary windings L1 and L2, the excitation flux $\Phi_{excitation\ 1}$ and $\Phi_{excitation\ 2}$ generated by L1 and L2 in the integrated magnetic circuit of the primary core are superposed in the same direction; when a reverse pulse current is input into the primary windings L1 and L2, the excitation flux $\Phi_{excitation\ 1}$ and $\Phi_{excitation\ 2}$ generated by L1 and L2 in the superposed sheet-shaped iron-core integrated magnetic circuit will be superposed in the same direction, but the direction of the excitation flux will be opposite to the excitation flux in the case of the positive pulse current. If no current is input into L1 and L2, no magnetic flux will be formed in the whole loop of the rectangular closed-loop laminated iron core. Only between the two magnetic poles of the left-sided permanent magnet assembly, the permanent magnet flux $\Phi_{permanent\ 1}$ will be formed in the partial section of the vertical framework at the left side of the rectangular closed loop of the laminated iron core; and similarly, between the two magnetic poles of the right-sided permanent magnet assembly, the permanent magnet flux $\Phi_{permanent\ 2}$ will be formed in the partial section of the vertical framework. at the right side of the rectangular closed loop of the laminated iron core. At this moment, the permanent magnet fluxes $\Phi_{permanent\ 1}$ and $\Phi_{permanent\ 2}$ do not make contributions to the total magnetic flux of the rectangular closed loop, and the total magnetic flux $\Phi_{total}$ of the rectangular closed loop is 0 (zero), so that no induction electromotive force is output from both ends of the secondary winding L.

If a positive pulse current is input into L1 and L2, as shown in FIG. 4, the excitation flux $\Phi_{excitation\ 1}$ and $\Phi_{excitation\ 2}$ will be formed in the integrated magnetic circuit of the rectangular closed-loop laminated iron core, and the direction of excitation flux will be counter-clockwise. Meanwhile, the originally closed permanent magnet flux $\Phi_{permanent\ 1}$ of the left-sided permanent magnet assembly will be opened under the push of the excitation flux, and is imported into the integrated magnetic circuit of the rectangular closed-loop laminated iron core. At this moment, the total magnetic flux in the integrated magnetic circuit of the laminated iron core will be $\Phi_{total}=\Phi_{excitation\ 1}+\Phi_{excitation\ 2}+\Phi_{permanent\ 1}$, so that the corresponding positive electromotive force will be induced at both ends of the secondary winding L. During this period, the permanent magnet flux $\Phi_{permanent\ 2}$ of the right-sided permanent magnet assembly still exists.

If a negative pulse current is input into L1 and L2, as shown in FIG. 5, the excitation flux $\Phi_{excitation\ 1}$ and $\Phi_{excitation\ 2}$ will be formed in the integrated magnetic circuit of the rectangular closed-loop laminated iron core, and the direction of excitation flux will be clockwise. Meanwhile, the originally closed permanent magnet flux $\Phi_{permanent\ 2}$ of the rights-sided permanent magnet assembly will be opened under the push of the excitation flux, and is imported into the integrated magnetic circuit of the rectangular closed-loop laminated iron core. At this moment, the total magnetic flux in the integrated magnetic circuit of the laminated iron core will be $\Phi_{total}=\Phi_{excitation\ 1}+\Phi_{excitation\ 2}+\Phi_{permanent\ 2}$, so that the corresponding reverse electromotive force will be induced at both ends of the secondary winding L. During this period, the permanent magnet flux $\Phi_{permanent\ 1}$ of the left-sided permanent magnet assembly still exists.

In this second embodiment, the primary windings L1 and L2 connect in series. Under condition of not increasing the volume and weight of the transformer device, it raises the total excitation flux in the integrated magnetic circuit of the rectangular closed-loop laminated iron core, so as to strengthen the positive and reverse induction electromotive force at both ends of the secondary winding L.

In this second embodiment, in order to ensure that every pulse current input into primary windings L1 and L2 could obtain the compounding and superposition effects of permanent magnet flux and excitation flux, the positive and negative square wave pulse current alternatively input into L1 and L2 shall reach the determined amplitude, and the amplitude of every square wave pulse current shall be ensured to be higher than a threshold. Namely the density of excitation flux which could be generated by every pulse current in the closed synergistic closed magnetic loop shall be higher than a threshold, namely meeting the condition of that $(\Phi_{excitation\ 1}+\Phi_{excitation\ 2})\geq\Phi_{permanent\ 1}$ or the condition of that $(\Phi_{excitation\ 1}+\Phi_{excitation\ 2})\geq\Phi_{permanent\ 2}$. Hence, in the synergistic closed magnetic loop and under the excitation flux of the primary winding, the original static permanent magnet flux changes its direction, and turns into dynamic flux. The dynamic flux is superposed and compounded with the electric excitation flux. In synergistic magnetic loop, new closed magnetic loop is formed. This superposed and compound magnetic flux $\Phi_{total}$ cuts the secondary winding wound on the magnetic loop of laminated iron core, and produces an induction electromotive force of compound excitation. This induction electromotive force of compound excitation is obviously higher than the induction electromotive force of simple electric excitation. If the value of the input excitation pulse current is maintained unchanged, and the frequency of the pulse current input into the primary windings L1 and L2 is changed, it will be able to obtain the secondary winding induction electromotive force of compound excitation at different frequencies. This voltage regulating and control method is to change and adjust the input and output power of this AC permanent-magnet synergistic transformer device by changing the average pulse count per unit time of pulse current input for the primary winding.

Embodiment 3

This embodiment illustrates a transformer with a round closed-loop laminated iron core, and its structure is as shown in the FIGS. 6-12.

Figure 6:
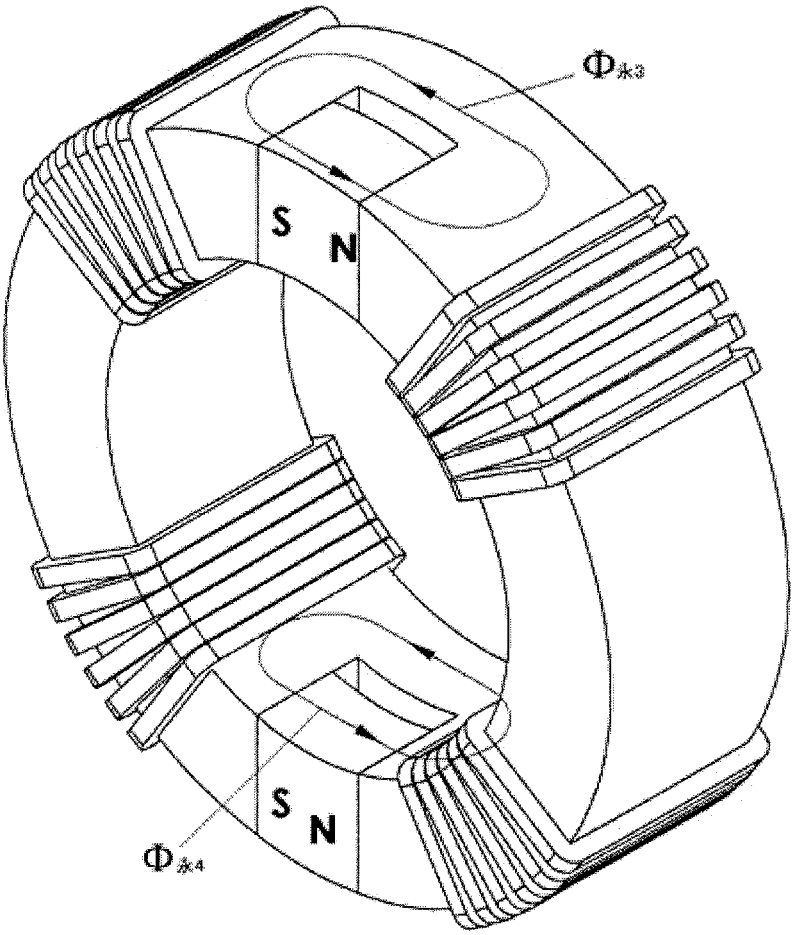
FIG. 6 is the schematic diagram of the outline structure of transformer device and the direction of permanent magnet flux in the laminated iron core under condition that primary windings L1 and L2 are mutually independent and not powered on, as shown in the second embodiment of this invention.

In this embodiment, the laminated iron core 21 is made of many layers of 0.003 mm thick iron-based nano alloy soft-magnetic material by means of lamination, and the laminated surface of the laminated iron core is vertical to the paper surface. As shown in FIG. 6, at the gap right above and the gap right below the laminated iron core, two permanent magnets 20 and 26 are set up respectively. The magnetic pole N of the upper permanent magnet 20 closely clings to the laminated iron core in the clockwise direction, while the magnetic pole S of the lower permanent magnet 20 closely clings to the laminated iron core in the counter-clockwise direction, and an air gap 27 exists between the inner lateral side of the upper permanent magnet 20 and the laminated iron core. The magnetic pole N of the lower permanent magnet 26 closely clings to the laminated iron core in the counter-clockwise direction, the magnetic pole S of the lower permanent magnet 26 closely clings to the laminated iron core in the clockwise direction, and an air gap 28 also exists between the inner lateral side of the lower permanent magnet 26 and the laminated iron core. Primary windings L1 and L2 are set up at symmetric positions with respect to the diameter line the round closed-loop laminated iron core 21, the secondary windings La and Lb are set up at the symmetric positions with respect to the diameter line of the round closed-loop laminated iron core 21, and the secondary windings La are Lb are connected in series.

Figure 7:
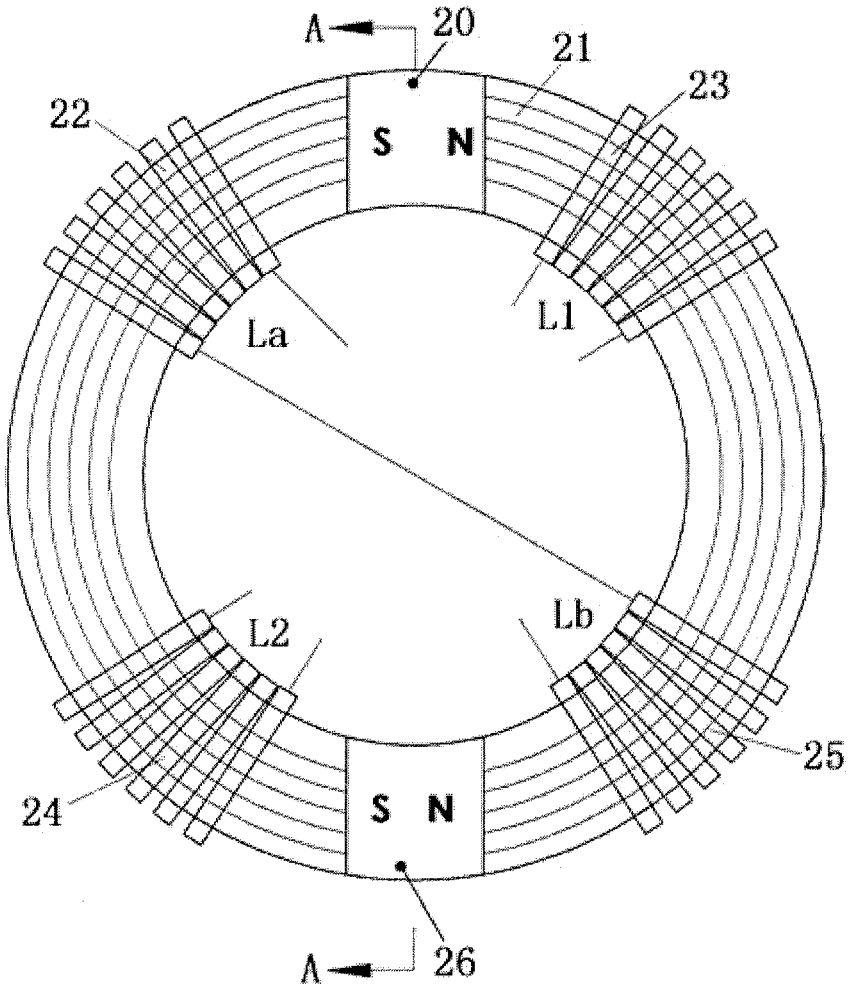
FIG. 7 is the schematic diagram of front-side structure of the transformer device under condition that primary windings L1 and L2 are mutually independent and not powered on, as shown in the second embodiment of this invention.
Figure 8:
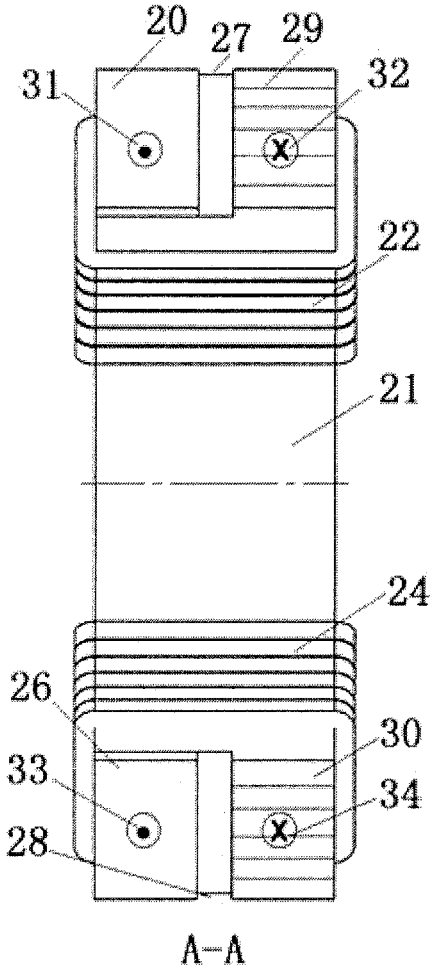
FIG. 8 is the schematic diagram (A-A sectional view of FIG. 7) of the direction of permanent magnet flux in the laminated iron core of transformer device under condition that primary windings L1 and L2 are mutually independent and not powered on, as shown in the second embodiment of this invention.

If no current is input into L1 and L2, as shown in FIGS. 6, 7 and 8, the upper permanent magnet 20 and the lower permanent magnet 26 face each other with same popularity, i.e., the magnetic pole S of the upper permanent magnet 20 faces the magnetic pole S of the lower permanent magnet 26, so that no magnetic flux is formed in the whole loop of the round closed-loop laminated iron core. Only between the upper permanent magnet 20 and the laminated iron core, the permanent magnet flux $\Phi_{permanent\ 3}$ will be formed. The magnetic line of the permanent magnet flux $\Phi_{permanent\ 3}$ will pass out from the permanent magnet, as illustrated by 31, and enter from the laminated iron core, as illustrated by 32. Similarly, between the lower permanent magnet 26 and the laminated iron core, the permanent magnet flux $\Phi_{permanent\ 4}$ will also be formed. The magnetic line will also pass out from the permanent magnet, as illustrated by 33, and enter from the laminated iron core, as illustrated by 34. At this moment, as shown in the FIGS. 6 and 8, the permanent magnet flux $\Phi_{permanent\ 3}$ and $\Phi_{permanent\ 4}$ do not make contribution to the total magnetic flux of the round closed-loop laminated iron core, and the total magnetic flux $\Phi_{total}$ of the round closed-loop laminated iron core is zero, so that no induction potential is output from both ends of the secondary windings La and Lb.

Figure 9:
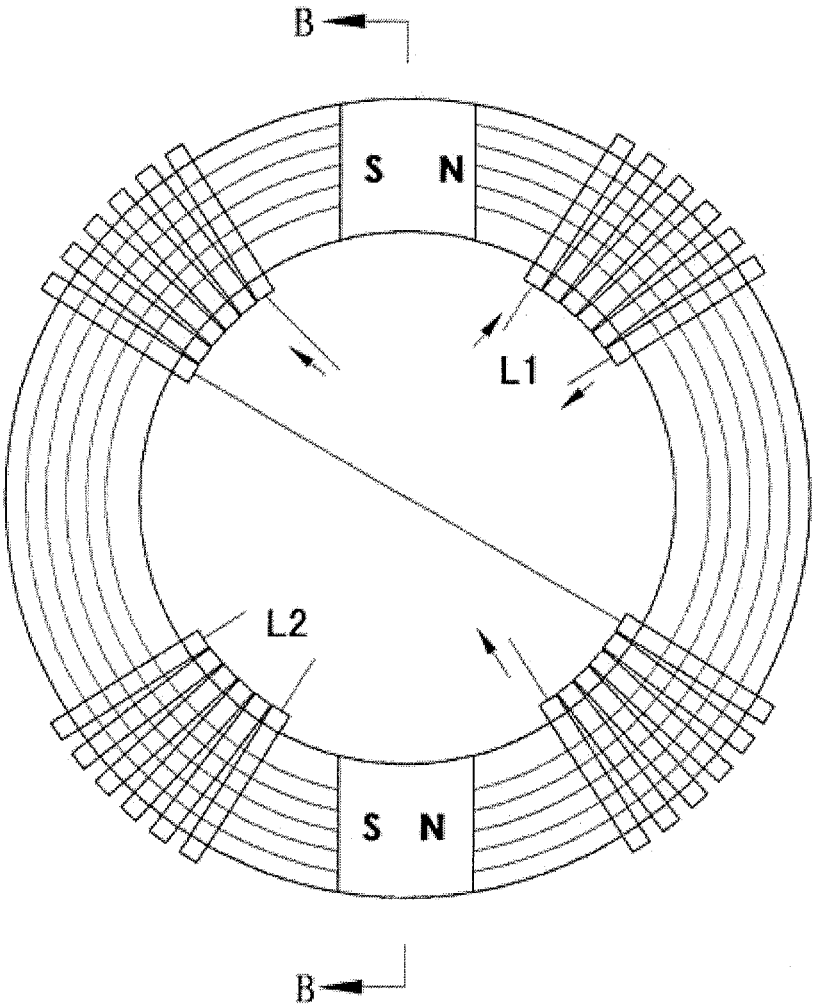
FIG. 9 is the schematic diagram of front-side structure of the transformer device under condition that primary windings L1 and L2 are mutually independent, primary winding L1 is powered on, and L2 is not powered on, as shown in the second embodiment of this invention.
Figure 10:
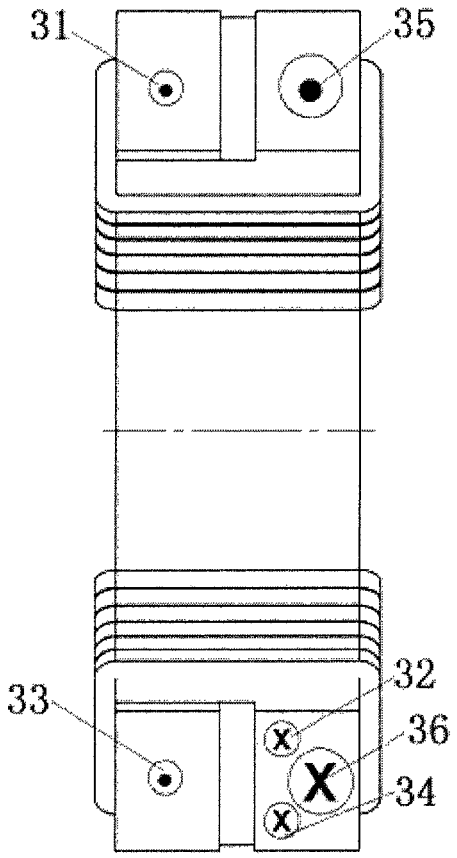
FIG. 10 is the schematic diagram (B-B sectional view of FIG. 9) of the direction of permanent magnet flux in the laminated iron core of transformer device under condition that primary windings L1 and L2 are mutually independent, primary line graph L1 is powered on, and L2 is not powered on, as shown in the second embodiment of this invention.

If a current is input into L1 but not input into L2, as shown in FIG. 9, L1 is excited with power supply, so that in the overall loop of the round closed-loop laminated iron core, the excitation flux $\Phi_{excitation\ 3}$ is formed. The magnetic line of the excitation flux $\Phi_{excitation\ 3}$ comes out from the upper side of the laminated iron core, as illustrated by 35, and enters from the lower part of the laminated iron core, as illustrated by 36. Meanwhile, the permanent magnet flux $\Phi_{permanent\ 3}$ of the upper permanent magnet will be imported into the round closed-loop integrated magnetic circuit, and the magnetic line of the permanent magnet flux $\Phi_{permanent\ 3}$ will come out from the upper permanent magnet, as illustrated by 31, and enter from the lower part of the laminated iron core, as illustrated by 32. At this moment, the total magnetic flux in the integrated magnetic circuit of the round closed-loop laminated iron core will be $\Phi_{total}=\Phi_{excitation\ 3}+\Phi_{permanent\ 3}$, and the corresponding positive electric potential will be induced at both ends of the secondary windings La and Lb. During this period, the permanent magnet flux $\Phi_{permanent\ 4}$ of the lower permanent magnet still exists, and the magnetic line of this permanent magnet flux $\Phi_{permanent\ 4}$ will come out from the lower magnet, as illustrated by 33, and enter from the lower laminated iron core, as illustrated by 34, as shown in FIG. 10.

Figure 11:
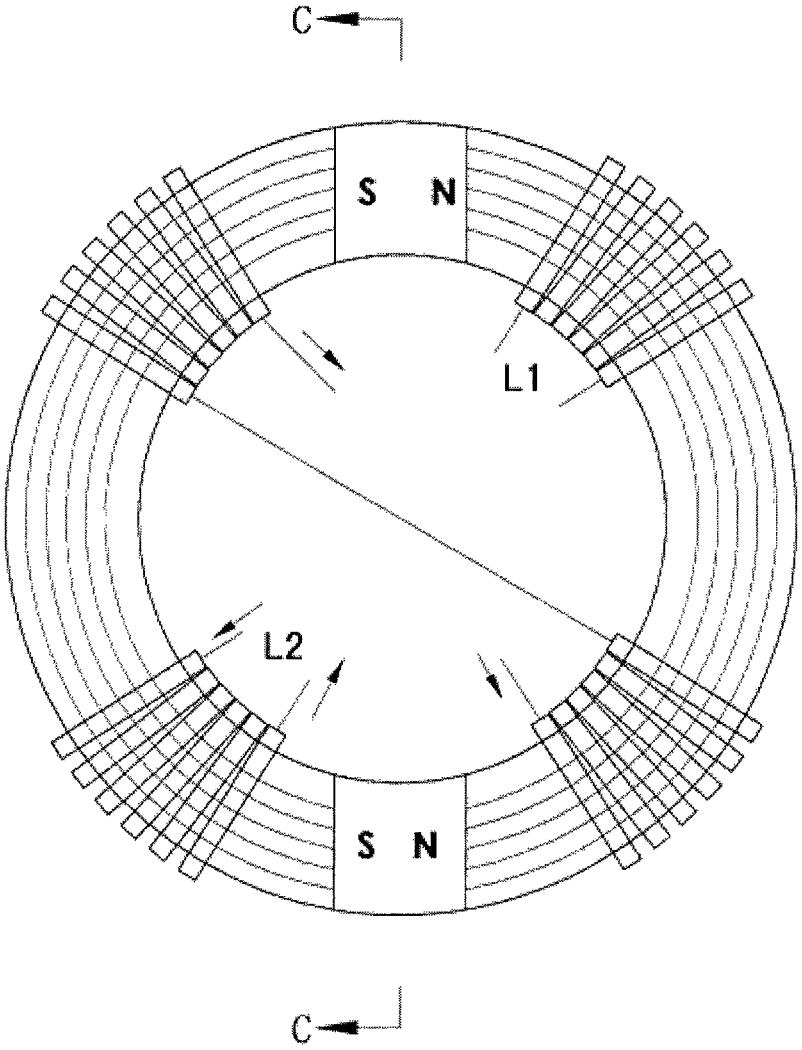
FIG. 11 is the schematic diagram of front-side structure of the transformer device under condition that primary windings L1 and L2 are mutually independent, primary line graph L1 is powered on, and L2 is not powered on, as shown in the second embodiment of this invention.
Figure 12:
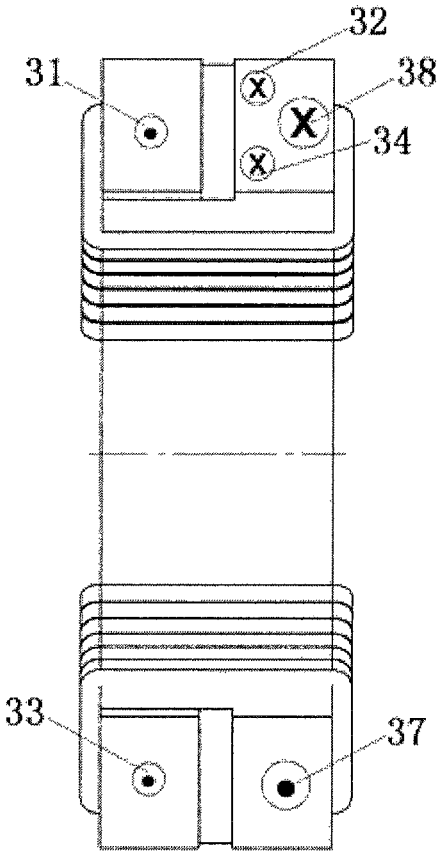
FIG. 12 is the schematic diagram (C-C sectional view of FIG. 11) of the direction of permanent magnet flux in the laminated iron core of transformer device under condition that primary windings L1 and L2 are mutually independent, primary line graph L1 is not powered on, and L2 is powered on, as shown in the second embodiment of this invention.

If a current is input into L2 and not input into L1, as shown in FIG. 11, since L2 is excited by power supply, so that in the round closed-loop integrated magnetic circuit, the excitation flux $\Phi_{excitation\ 4}$ is formed. The magnetic line of the excitation flux $\Phi_{excitation\ 4}$ comes out from the lower part of the laminated iron core, as illustrated by 37, and enters from the upper part of the laminated iron core, as illustrated by 38. Meanwhile, the permanent magnet flux $\Phi_{permanent\ 4}$ of the lower permanent magnet is imported into the round closed-loop integrated magnetic circuit. The magnetic line of the permanent magnet flux $\Phi_{permanent\ 4}$ comes out from the lower permanent magnet, as illustrated by 33, and enters from the upper part of the laminated iron core, as illustrated by 34. At this moment, the total magnetic flux in the round closed-loop integrated magnetic circuit is $\Phi_{total}=\Phi_{excitation\ 4}+\Phi_{permanent\ 4}$, and the corresponding positive electric potential could be induced at both ends of the secondary windings La and Lb. During this period, the permanent magnet flux $\Phi_{permanent\ 3}$ of the upper permanent magnet still exists; the magnetic line of this permanent magnet flux $\Phi_{permanent\ 3}$ comes out from the upper permanent magnet, as illustrated by 31, and enters from the upper side of the laminated iron core, as illustrated by 32, as shown in FIG. 12.

If a current is alternatively input into primary windings L1 and L2, the positive and reverse electric potentials will be induced at both ends of the secondary windings La and Lb. Also, the input end of a bridge-type rectifier and filter circuit may be connected at both ends of the secondary windings La and Lb, and then, DC current may be output from the bridge-type rectifier and filter circuit.

In this embodiment, it is ensured that every pulse current input into primary windings L1 and L2 could obtain the compounding and superposition effects of permanent magnet flux and excitation flux. The same voltage regulating and control method as that of embodiment 1 is to change and adjust the input and output power of this AC permanent-magnet synergistic transformer device by changing the pulse count per unit time of pulse current input for the primary winding; since the same voltage regulating and control method as that of embodiment 1 may be adopted, it won't be described repeatedly here.

In this embodiment, the permanent magnet is embedded into the gap(s) of the laminated iron core, so that the transformer of this embodiment has compact structure, which is applicable to small-volume microscopic electronic transformers.

Embodiment 4

This embodiment illustrates another transformer with the round closed-loop laminated iron core, and its structure is similar to that of embodiment 3 (refer to FIG. 6 and FIG. 7). The difference only rests with that the primary windings L1 and L2 are connected in series, and the winding method of primary windings L1 and L2 meets the following conditions: when a positive pulse current is input into the primary windings L1 and L2, the excitation flux $\Phi_{excitation\ 3}$ and $\Phi_{excitation\ 4}$ generated in the integrated magnetic circuit of round closed-loop laminated iron core arc superposed in the same direction, such as in clockwise direction; when a reverse pulse current is input into the primary windings L1 and L2, the excitation flux $\Phi_{excitation\ 3}$ and $\Phi_{excitation\ 4}$ generated in the integrated magnetic circuit of round closed-loop laminated iron core are also superposed in the same direction, but the direction of the excitation flux will be changed to counter-clockwise direction.

In this embodiment, the following aspects (such as the compounding mechanism and process of permanent magnet flux and excitation flux; the method for restricting or preventing excitation flux from entering into the permanent-magnet magnetic loop of the permanent magnet; and the synergistic effect of the compound magnetic flux on the secondary winding) are all similar to those of embodiment 2, and thus won't be repeated here.

In this embodiment, in order to ensure that every pulse current input into primary windings L1 and L2 could obtain the compounding and superposition effects of permanent magnet flux and excitation flux, and to change and adjust the input and output power of this AC permanent-magnet synergistic transformer device by changing the pulse count per unit time of pulse current input for the primary winding, the same voltage regulating and control method as that of embodiment 2 may be adopted, and it won't be described repeatedly here.

The invention claimed is:

1. An AC permanent magnet gain transformer device, consisted of a round closed-loop laminated iron core, a primary winding and a secondary winding, wherein, said AC permanent magnet gain transformer device further includes two permanent magnet, wherein there are two gaps at opposite angle positions with respect to the diameter line of the round closed-loop laminated iron core respectively, and the two permanent magnets are embedded into the two gaps, wherein the magnetic pole N of a first permanent magnet closely clings to the laminated iron core in clockwise direction, and its magnetic pole S closely clings to the laminated iron core in counter-clockwise direction;

the magnetic pole N of a second permanent magnet closely clings to the laminated core in counter-clockwise direction, and its magnetic pole S closely clings to the laminated iron core in clockwise direction;

an air gap is set between the lateral sides of the two permanent magnets and the laminated iron core;

wherein said primary windings are divided into L1 group and L2 group, and the L1 group and L2 group are wounded at diagonal positions of the framework of the round closed-loop laminated iron core respectively;

wherein said secondary winding L is divided into two windings La and Lb, wherein the windings La and Lb are wounded at the diagonal positions of the framework of the round closed-loop laminated iron core respectively, and are located between said primary windings L1 and L2, wherein the windings La and Lb are connected in series or in parallel, as output end.

2. The AC permanent magnet gain transformer device according to claim 1, wherein, the said primary windings L1 and L2 are mutually independent, and a unidirectional pulse current is alternatively input into the primary windings L1 and L2;

the primary winding L1 is wound such that the direction of electric excitation magnetic field generated when current is input is the same as the direction of the magnetic field of the first permanent magnet located closest to the primary winding L1, namely in the round closed-loop magnetic loop, the electric excitation magnetic field of L1 is opposite to the electric excitation magnetic field of L2, and in ring-shaped magnetic loop, the direction of magnetic field of the first permanent magnet is opposite to the direction of magnetic field of the second permanent magnet;

or wherein, the said primary windings L1 and L2 are connected in series, the primary windings L1 and L2 are wound such that, when positive pulse current is input into the primary windings L1 and L2, the superposition of electric excitation flux of L1 and L2 is formed inside the round closed-loop laminated iron core, and the direction of excitation flux is positive;

when reverse pulse current is input into the primary windings L1 and L2, the superposition of electric excitation flux of L1 and L2 is formed inside the round closed-loop laminated iron core, and the direction of excitation flux is reverse.

3. The AC permanent magnet gain transformer device according to claim 1, wherein, the laminated surface of the said round closed-loop laminated iron core is vertical to a paper surface, and the magnetic pole N and magnetic pole S of permanent magnet closely cling to the laminated section of the round closed-loop laminated iron core;

or wherein, the laminated surface of the said round closed-loop laminated iron core is vertical to the paper surface, and the magnetic pole N and magnetic pole S of permanent magnet closely cling to the laminated section of the round closed-loop laminated iron core.

4. The AC permanent magnet gain transformer device according to claim 3, wherein, the said round closed-loop laminated iron core is made of sheet-shaped iron-based nano alloy soft-magnet material by means of lamination and winding.

5. A method for voltage regulation and control of an AC permanent magnet gain transformer device, wherein, the method for voltage regulation and control is to change the pulse count in an unit time of the pulse current input into primary windings in the precondition that the amplitude of every pulse current input into the primary windings could obtain the compounded and superimposed effect of permanent magnet flux and excitation flux, so as to change and adjust the input and output power of the AC permanent magnet gain transformer device;

the method for the voltage regulation and control comprising the steps in that:

wherein in a synergistic closed magnetic loop along with matching parameters and jointly consisting of a permanent magnet, a laminated iron core, a primary winding and a secondary winding, positive and negative alternating pulse current of square wave or approximate square wave is used to excite the primary winding, in order to ensure that the amplitude of every pulse current of square wave or approximate square wave is higher than a threshold, such that the density of excitation flux generated by the amplitude of every pulse current in the closed synergistic closed magnetic loop is higher than a threshold, or such that the density of excitation flux generated is equal to or higher than the density of the static permanent magnet flux formed by the permanent magnet assembly set up in parallel with the primary winding, wherein in the synergistic closed magnetic loop and under the electric excitation flux of primary winding, the original permanent magnet flux changes the direction, turns into dynamic flux, and is superposed and compounded with the electric excitation flux;

wherein in the synergistic magnetic loop, new closed magnetic loop is formed;

wherein the superposed and compound magnetic flux cuts the secondary winding wound on the magnetic loop of laminated iron core, and produces induction electromotive force of compound excitation;

such that the induction electromotive force of compound excitation is higher than the induction electromotive force of simple electric excitation;

such that when the value of the input excitation pulse current is maintained unchanged and when the frequency of positive and negative alternating current pulse is changed, the secondary winding induction electromotive force of the compound excitation at different frequencies is obtained.

* * * * *